US008123268B1

(12) United States Patent
Conrad

(10) Patent No.: US 8,123,268 B1
(45) Date of Patent: Feb. 28, 2012

(54) HEAVY LOAD SLING PROTECTIVE PAD

(75) Inventor: Selina Conrad, Lorton, VA (US)

(73) Assignee: The Rigging Box, Inc., Lorton, VA (US)

( * ) Notice: Subject to any disclaimer, the term of this patent is extended or adjusted under 35 U.S.C. 154(b) by 0 days.

(21) Appl. No.: 12/881,427

(22) Filed: Sep. 14, 2010

(51) Int. Cl.
*B66C 1/12* (2006.01)

(52) U.S. Cl. ..... 294/74

(58) Field of Classification Search ..... 294/74; 410/99; 206/453, 486; 428/99
See application file for complete search history.

(56) References Cited

U.S. PATENT DOCUMENTS 4,039,217 A * 8/1977 Bryant ..... 294/74
(Continued)

OTHER PUBLICATIONS

SlingMAX Rigging Solutions Handbook, Aug. 2002.

*Primary Examiner* — Paul T Chin
(74) *Attorney, Agent, or Firm* — Whitham Curtis Christofferson & Cook, PC

(57) ABSTRACT

A heavy load protective pad for use on industrial slings includes fasteners on a sleeve forming member which are secured together to encircle and secure the protective pad on an industrial sling at a desired location. Pockets formed in the protective pad house a pair of block spacers which, in one configuration, serve to space the protective pad and underlying sling away from the load which is being lifted or pulled.

7 Claims, 3 Drawing Sheets

U.S. PATENT DOCUMENTS 4,039,218 A * 8/1977 Bryant ..... 294/74
4,877,673 A * 10/1989 Eckel et al. ..... 206/453
5,385,236 A * 1/1995 Cowan et al. ..... 206/453
6,470,637 B2 10/2002 Gratz
7,311,483 B1 * 12/2007 Nudo ..... 410/99
7,744,138 B2 6/2010 St. Germain

* cited by examiner

HEAVY LOAD SLING PROTECTIVE PAD

BACKGROUND OF THE INVENTION

1. Field of the Invention

The invention is related to pad devices for industrial slings that are designed to lift or pull heavy loads (e.g., machinery, structural members, concrete objects, etc.), and more particularly to protective pad devices which protect such slings from the edges or corners of these loads (e.g., shipping container edges, etc.)

2. Background Description

Industrial slings are used to lift and move heavy objects. They are used at shipping yards, construction sites, loading areas, and in a wide variety of other applications. Industrial slings have been made from chains and wire cables in the past; however, many of today's slings (e.g., those employed in the last two decades) are made of tough and durable fibers, and they resemble a strap which is wrapped around the load for lifting and/or pulling operations. These fiber slings can be subject to catastrophic failure if they are cut, subjected to abrasion, or are otherwise worn down. This type of damage can occur when the object being lifted or pulled has a sharp corner or edge, and the sling is held taught against the edge during the lifting or pulling operation.

As discussed in U.S. Pat. No. 7,744,138 to St. Germain, which is herein incorporated by reference, there are a number of ways the problem of sling degradation and failure can be addressed. For example, the object to be lifted (e.g., a pipe section, a cargo container, structural steel, etc.) can be fabricated with eye bolts or hooks, and the sling would be slipped through the eye bolts or hooks for lifting operations. After moving the object, the eye bolts or hooks could be removed. Another example is to manufacture protectors from angular pieces of cardboard that abut against edges of the objects to be moved (e.g., U.S. Pat. No. 6,470,637 to Gratz describes molded pulp corner protector to protect windows during shipment).

U.S. Pat. No. 7,744,138 to St. Germain, as well as the Cornermax™ sold by Slingmax for many years prior to the filing of the St. Germain patent, describe corner pads used with industrial slings. These pads form a tunnel between load edge and the pad so that the pad as well as the underlying sling are protected from contacting the load edge during lifting or pulling. However, these corner pads are somewhat cumbersome as they require two pairs of mating straps to be looped around the sling and joined together by Velcro® (hook and loop connector).

SUMMARY

An object of the invention is to provide a more compact corner protector for use on an industrial sling.

According to the invention, a heavy load industrial sling protective pad is constructed from a sleeve forming member. The sleeve forming member is preferably a tough sleeve shaped material such as Cordura®, Kevlar®, or other fibrous material which can withstand abrasion, exposure to water and ultraviolet radiation, heat, etc. that may be encountered when using industrial slings. Fasteners, such as strips of Velcro® (hook and loop connectors), are preferably sewn to the top surface of the sleeve forming member on its first and second edges. The sleeve forming member can thus be attached to an industrial sling at any location required for protecting the industrial sling simply by placement at the desired location and fastening the fasteners together to encircle and secure the sleeve forming member to the industrial sling.

In one portion of the sleeve forming member (e.g., the top or bottom half, etc.) there are a pair of pockets which preferably hold block spacers. The pockets are created by stitching in the sleeve forming member. In a preferred embodiment there is a central stitch line which divides the sleeve forming member generally in half, and a generally perpendicular stitch line which divides at least the top and/or bottom half into, e.g., quarters. The block spacers are inserted into these pockets and the pockets are sewn closed. Preferably, the inside of the pockets are lined with a Kevlar® felt or other tough material which can withstand ripping and cutting. The block spacers, have height, depth and width dimensions. The height of the block spacers is such that a gap between the generally perpendicular stitch line between the pockets and a top edge of the block spacers is created when one of the block spacers is positioned on a load on one side of an edge and the other block spacer is positioned on the load on the other side of the edge.

In one configuration, this gap prevents the corner at the edge of the load from contacting the sleeve forming member or the underlying sling during heavy lifting and pulling operations. In this configuration, the sleeve forming member is secured to the sling by the fasteners such that the block spacers are interposed between the sling and the load which is being lifted or pulled. An alternative configuration of the heavy load protective pad allows the block spacers to be positioned on the sling spaced away from the load. In this configuration, the block spacers may be used to, for example, protect portions of the load from being crushed when the load is set down on a surface.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION

Figure 1:
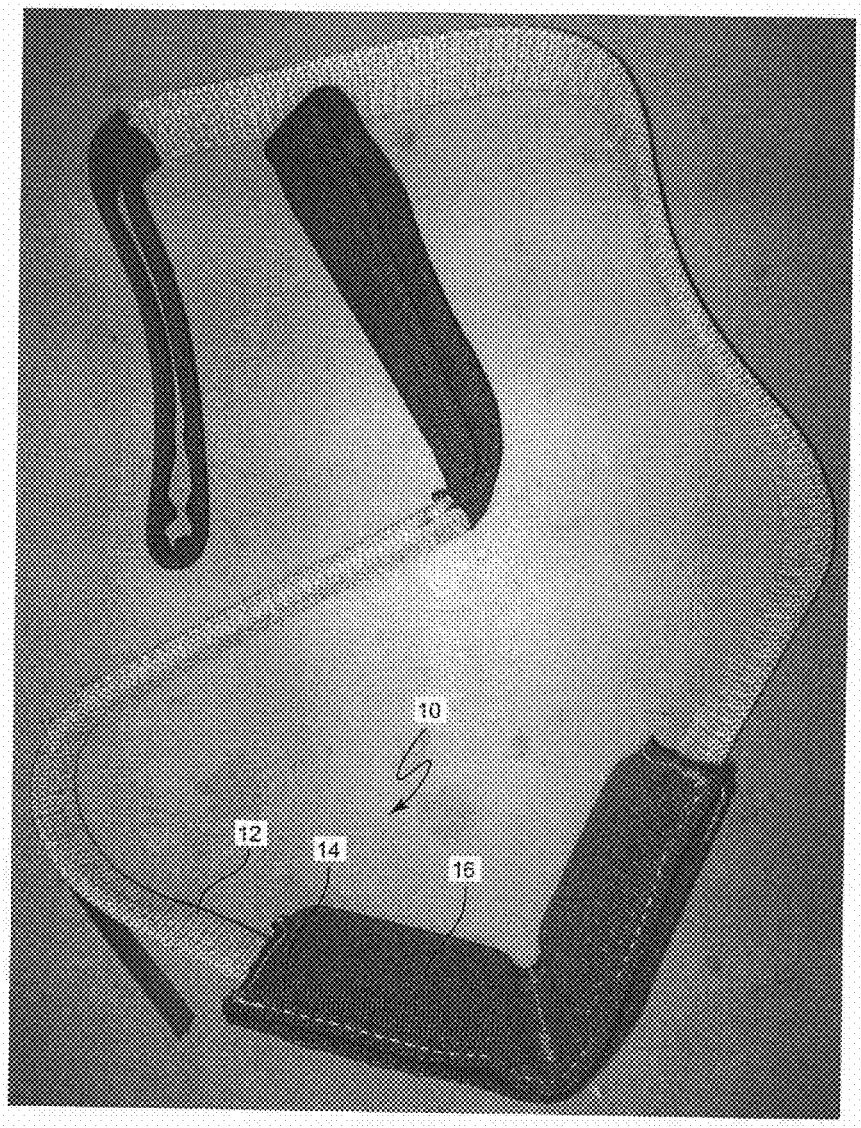
FIG. 1 is an isometric view of an exemplary heavy load protective pad secured to an industrial sling.

FIG. 1 shows an example of a heavy load protective pad 10 according to the present invention. The pad 10 is secured to an industrial sling 12 at any desired location simply by encircling the sling 10 and joining fasteners 14 at the top and bottom edges of a sleeve forming member 16.

Figure 2B:
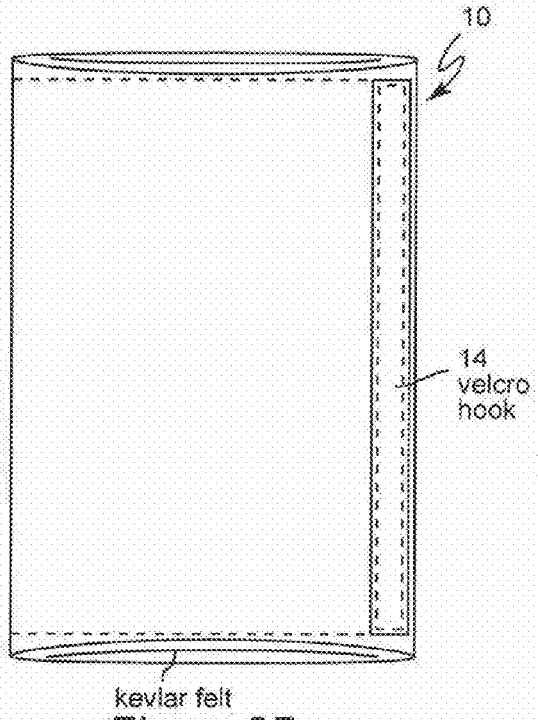
FIG. 2*b* is a plan view of the bottom half of the heavy load protective pad of FIG. 2*a;*
Figure 2C:
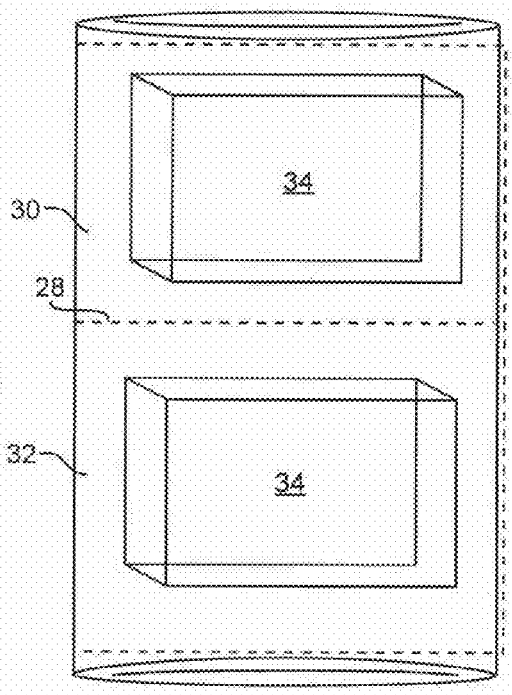
FIG. 2*c* is a cut-away plan view of the top half of the heavy load protective pad of FIG. 2*a* showing block spacers within the pockets in the top half.
Figure 2A:
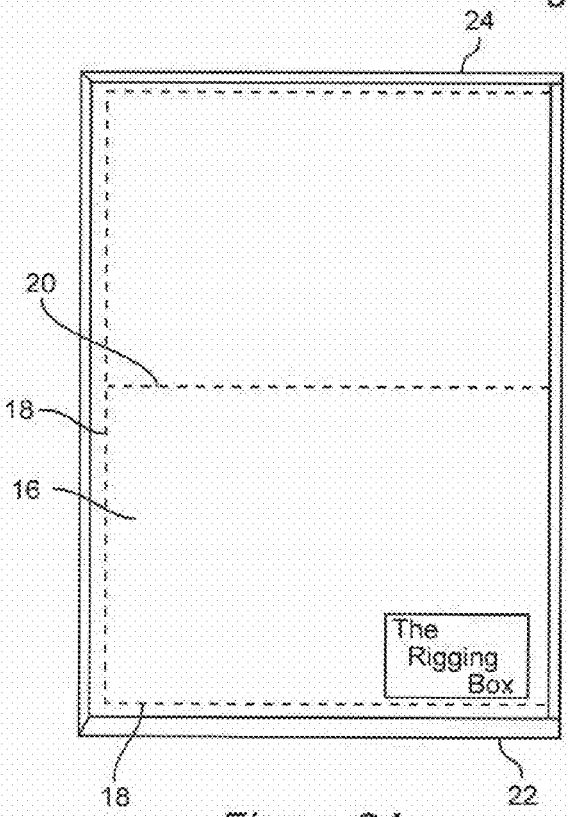
FIG. 2*a* is a plan view of an exemplary heavy load protective pad where the protective sleeve member is open.

With reference to FIG. 2*a*, it can be seen that the heavy load protective pad 10 is composed of a sleeve forming member 16. The sleeve forming member 16 is preferably a sleeve of material that is tough, durable, etc., such as a Cordura® or Kevlar® sleeve. Almost any material that is formed from fibers (synthetic or natural), which can withstand abrasion, cuts, water damage, and ultraviolet damage, or any other adverse condition in which industrial slings will be used could be used as the sleeve forming member 16. Further, while the sleeve forming member 16 is preferably itself a sleeve of material, in some applications the sleeve forming member 16 could be formed of two sheets of material that are joined together by stitching. FIG. 2*a* shows stitching 18 along the edges of the sleeve forming member, as well as central stitching 20 that essentially divides the sleeve forming member 16 into top and bottom halves.

Velcro® (hook and loop) strips are preferably sewn on the underside of the sleeve forming member at the top 24 and bottom 22 edges. With reference back to FIG. 1, it can be seen that the Velcro® functions as a fastener 14 to secure the sleeve forming member 16 to the industrial sling at the desired location. Other fasteners, e.g., hooks, snaps, buttons, etc., might also be employed to secure the protective pad 10 to the industrial sling 10.

FIG. 2*b* shows the bottom half of the sleeve forming member 16 and illustrates the Velcro® secured to one edge of the sleeve forming member by stitch lines 26.

FIG. 2*c* shows a cut away view of the top half of the sleeve forming member 16. A stitch line 28 which is generally perpendicular to the central stitch line 20 shown in FIG. 2*b*, creates pockets 30 and 32 within the sleeve forming member 16. Inside each pocket 30 and 32 is placed a block spacer 34. The block spacers 34 can be the same or different and can be formed from a wide variety of materials including metals (e.g., steel, aluminum, etc.), polymers (e.g., plastics), and ceramics. The block spacers 34 have height, width and length dimensions to allow them to fit within the pockets 30 and 32. The height of the block spacers 34 can vary (e.g., ½ to 1 inch, etc.) considerably and functions, together with the stitch line 28 to create a gap between the sleeve forming member 16 and the load in the configuration discussed below in connection with FIG. 3*a*. Preferably, the pockets 30 and 32 (or the entire interior surfaces of the sleeve forming member 16) are lined with an anti-abrasion material such as Kevlar® felt to help withstand ripping of the sleeve forming member at the edges of the block spacers 34.

Figure 3A:
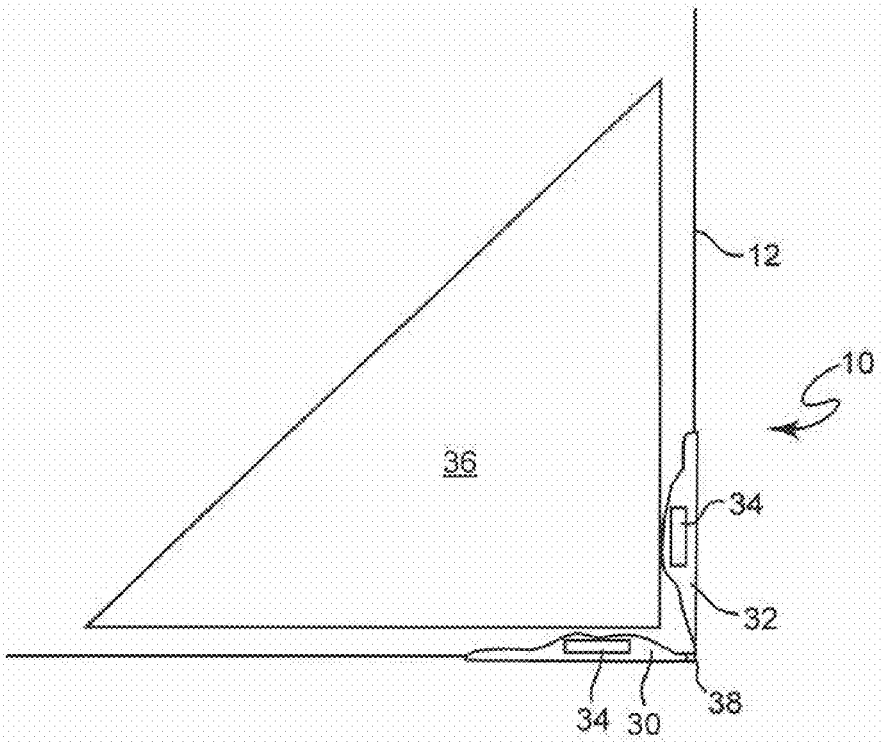
FIGS. 3*a-b* are alternative configurations of an exemplary heavy load protective pad in use with a sling in the presence of a load.

FIG. 3*a* shows one configuration for using the heavy load sling protective pad 10. In FIG. 3*a*, the block spacers 34 in the pockets 30 and 32 are positioned between the load 36 and the sling 12. In this configuration, the block spacers 34 and stitch line 28. (shown in FIG. 2*b*) create a gap 38 at the corner or edge of the load 36. In this way, the corner edge of the load does not contact the sleeve forming member 16 or the underlying sling 12, even when the load is being lifted or pulled.

Figure 3B:
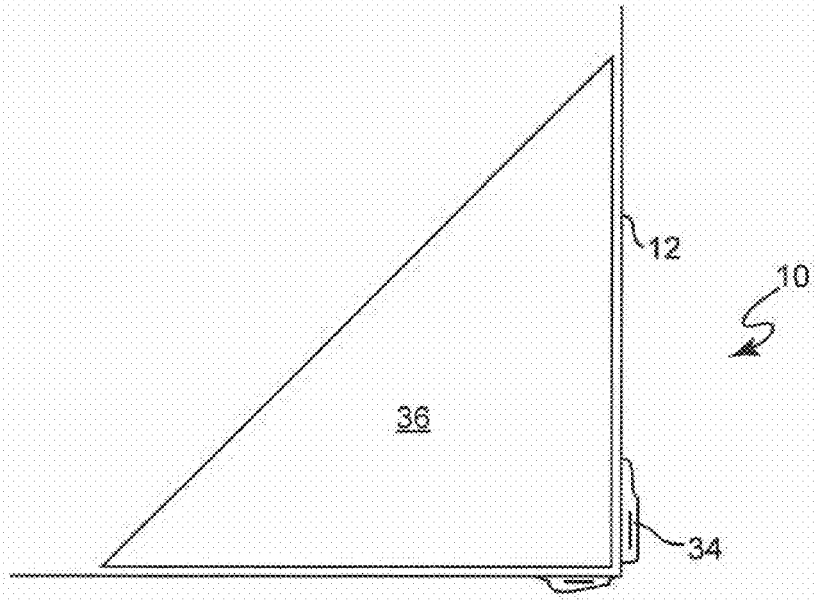

FIG. 3*b* shows an alternative configuration for using the heavy load sling protective pad 10 of the present invention. In FIG. 3*b*, the pad 10 is attached to the sling 12 such that the block spacers 34 are facing away from the load 36. In this configuration, protruding features of the load (not shown) might be protected from damage when the load 36 is set on a surface due to the block spacers 34 spacing the load 36 from the surface.

While the invention has been described in terms of its preferred embodiments, those skilled in the art will recognize that the invention can be practiced with modification within the spirit and scope of the appended claims.

Having thus described my invention, what I claim as new and desire to secure by Letters Patent is as follows:

1. A heavy load industrial sling protective pad, comprising:

a sleeve forming member;

fasteners on opposing first and second sides of said sleeve forming member wherein when said fasteners are joined, said sleeve forming member forms a sleeve which will encircle and secure the sleeve forming member to an industrial sling;

first and second pockets defined by stitching in said sleeve forming member, said stitching including a first portion generally along a center line of said sleeve forming member between said first and second sides of said sleeve forming member, said stitching including a second portion generally perpendicular to said center line in at least one of said opposing first and second sides of said sleeve forming member, wherein said first and second portion of said stitching forms said first and second pockets in said at least one of said first and second sides of said sleeve forming member; and a block spacer positioned in each of said first and second pockets, each of said block spacers having height, length and width dimensions wherein said height dimension is sufficient to space an edge or a corner of a load away from said industrial sling by forming a gap between said block spacers in said first and second pockets and said second portion of said stitching when said sleeve forming member is positioned on said industrial sling in a first configuration with said block spacers facing said load, wherein said fasteners are hook and loop fasteners which include a first strip which spans a first edge of said sleeve forming member and a second strip which spans a second edge of said sleeve forming member, where said sleeve forming member forms a sleeve when said first strip is affixed to said second strip.

2. The heavy load industrial sling protective pad of claim 1, wherein said sleeve forming member has a top and a bottom surface, and wherein said a first strip of said hook and loop fasteners spans an entire length of said first edge of said sleeve forming member and is positioned on said top surface of said sleeve forming member, and wherein said second strip of said hook and loop fasteners spans an entire length of said second edge of said sleeve forming member and is positioned on said top surface of said sleeve forming member.

3. The heavy load industrial sling protective pad of claim 1 wherein at least one of said block spacers is made of a plastic material.

4. The heavy load industrial sling protective pad of claim 1 wherein at least one of said block spacers is made of a metal material.

5. The heavy load industrial sling protective pad of claim 1 wherein at least one of said block spacers is made of a ceramic material.

6. The heavy load industrial sling protective pad of claim 1 wherein said sleeve forming member is constructed so as to be capable of assuming a second configuration with said block spacers facing away from said load.

7. The heavy load industrial sling protective pad of claim 1 wherein said pockets are lined with an abrasion resistant material.

* * * * *